United States Patent [19]

Foster

[11] Patent Number: 4,883,131

[45] Date of Patent: Nov. 28, 1989

[54] CORE ORIENTATION SYSTEM

[76] Inventor: William B. Foster, P.O. Box 115, Garson, Ontario, Canada, P0M 1V0

[21] Appl. No.: 197,495

[22] Filed: May 23, 1988

[51] Int. Cl.[4] ..... E21B 25/16; E21B 47/024

[52] U.S. Cl. ..... 175/44; 175/45; 33/305

[58] Field of Search ..... 175/44, 45; 73/151; 33/304, 305

[56] References Cited

U.S. PATENT DOCUMENTS

| | | | |
|---|---|---|---|
| 1,860,932 | 5/1932 | Lamb | 33/305 |
| 1,959,666 | 5/1934 | Grant | 33/305 |
| 1,976,737 | 10/1934 | Leach | 33/305 X |
| 2,017,522 | 10/1935 | Bailey et al. | 175/44 |
| 2,030,015 | 2/1936 | McCurdy | 175/44 |
| 2,099,372 | 11/1937 | Reinhard | 33/305 X |
| 2,155,552 | 4/1939 | Jones | 33/305 |
| 2,580,510 | 1/1952 | Brody | 175/44 |
| 2,716,539 | 8/1955 | Pickard | 33/305 X |

FOREIGN PATENT DOCUMENTS

| | | | |
|---|---|---|---|
| 0981575 | 12/1982 | U.S.S.R. | 175/44 |

*Primary Examiner*—Bruce M. Kisliuk

*Attorney, Agent, or Firm*—Arne I. Fors; Robert F. Delbridge

[57] ABSTRACT

A core orientation device for determining the in situ orientation of core samples taken during a drilling process. A sampling tube having a plurality of equispaced slots formed longitudinally on its sidewall permits the scribing of a longitudinal line on a core sample within the sampling tube. The slots for indicating the position of the core within the sampling tube, a test tube with etch mark to indicate the top point or position of the etch mark within the test tube and a connector for relating the said top point on the test tube to the longitudinal slots on the sampling tube sidewall permit determination of the in situ position of the core sample.

9 Claims, 5 Drawing Sheets

CORE ORIENTATION SYSTEM

BACKGROUND OF THE INVENTION

1. Field of the Invention

This invention relates to a core orientation device for determining the orientation of core samples taken during a drilling process.

The apparatus allows one to obtain a diamond drilled core sample from the foot or bottom of a drilled hole, which can subsequently be repositioned in relation to its original attitude in the strata or formation as it was located prior to being "cored." This is done by establishing the dip of the bore hole, as well as the angular orientation of the core sample with respect to the bore hole axis. This latter involves establishing not only the orientation of the core tube, which holds the core sample, but also the orientation of the core sample itself with respect to the core tube.

"Wire line" drilling is the system of drilling most commonly used today. In wire line drilling, a string of rods made up of ten foot lengths of flush-threaded tubing is introduced into the bore hole. At the bottom or beginning of the rod string is an outer core barrel. Fastened to the bottom of the core barrel is a core bit which cuts a cylindrical core as it penetrates the formation.

As the core is produced it passes through the centre of the coring bit and enters the inner core barrel or core tube. The core tube remains stationary in relation to the core being produced as the bit revolves and penetrates the formation. This is accomplished by virtue of a set of bearings at the top of the core tube. The core tube is held in place by a set of latches locked into a locking coupling, at the top or back end of the core barrel. At the bottom of the core tube, which is located slightly behind the face of the coring bit, is a device called a core lifter. This unit contains a core spring which slips over the core as it is entering the core tube.

When the core tube has been filled, the drill is stopped and the rod string is pulled slightly. At this point the core spring grabs the core and breaks it from the bottom of the hole. The core then remains locked in the core tube. A device called an overshot is then lowered through the centre of the rod string on a small cable or "wire line". The overshot is lowered to a point where it latches onto the back or upper end of the core tube. This connection releases the set of latches of the locking coupling, which hold the core tube in place while the core is produced, and the tube is pulled to surface.

Without instrumentation, the only way to determine the inclination of geological formations in any hole is by drilling additional holes on either side of the first hole. This means that the formation will be intersected at either a higher or lower depth than in the first hole, or possibly not at all. A total of three holes, minimum, are required to interpret the direction of the bedding angle. The cost of drilling additional holes is high.

2. Description of the Prior Art

Accordingly, a number of instruments have been developed to provide information about the orientation of the sample. Some examples are found in the following U.S. Pat. Nos.: 2,650,069; 2,657,013; 2,707,617; 2,859,938; 3,032,127; 3,059,707; 3,363,703; 3,964,555; 4,128,134; 4,334,429; 4,311,201 and 4,542,648.

The above systems are generally quite complicated, and are aimed at orienting the sample with respect to the core tube the earth's strata. For orienting the core tube with respect to the hole, various means such as camera systems have also been used. U.S. Pat. No. 2,974,739, for example, shows the combination of a gun unit mounted in a core barrel adapted to fire missile into the rock to be cored, for marking the core, and a recording well unit including a camera to photograph shadows of a survey instrument. U.S. Pat. No. 3,450,216 discloses a core orienting apparatus including a multiple-shot camera and means to continually make groove marks along the length of a core.

In general, the above prior art systems suffer to varying degrees from various deficiencies, including complexity, cost, and unreliability.

SUMMARY OF THE INVENTION

It is therefore an object of the invention to provide a simple, relatively inexpensive and reliable core orientation device which establishes core orientation in situ before the core is broken from the bottom of the hole.

Thus in accordance with the present invention there is provided a core sampling and orientation apparatus comprising, in combination, a sampling tube having a front end and a rear end, said sampling tube having a cylindrical wall and a front end opening for receiving a core sample from a rock formation, said sampling tube including retention means for grasping said core sample, and said sampling tube having a plurality of slots, preferably equispaced, formed longitudinally along the cylindrical wall parallel to the tube longitudinal axis; a instrumentation housing tube having a front end and a rear end, means for securing the rear end of the sampling tube to the front end of the instrumentation tube, said securing means having angular orientation means to permit angular alignment of the sampling tube and said plurality of slots with the instrumentation housing tube; and means contained within said instrumentation housing tube for indicating the uppermost point of the instrumentation housing tube at a pre-determined time during core sampling, relative to the angular orientation means, whereby the core sample can be subsequently orientated to its original formation position.

The angular orientation means for angular alignment of the sampling tube with the instrumentation housing tube may comprise longitudinal lines formed on the sampling tube and on the orientation housing tube parallel to the respective axes thereof.

The means contained within the instrumentation housing tube for indicating the uppermost position of the instrumentation housing tube at a pre-determined time during sampling may comprise a glass test tube adapted for axial alignment within the instrumentation housing tube, indicia means for indicating a reference point on the test tube which corresponds with the slots formed on the sampling tube, and a glass-reactive acid in said glass test tube for etching a horizontal line in said glass test tube to indicate the uppermost point thereof.

A separate acid container and timing means for feeding a glass-reactive acid to the glass test tube may be provided.

Said timing means in one embodiment may comprise a membrane disposed between said acid container and the glass test tube, said membrane being reactive to the acid in the acid container whereby said acid will perforate said membrane in a predetermined period of time to permit acid to drain by gravity from said acid container into said glass test tube to mark a horizontal line in the wall of the glass test tube, i.e. a horizontal plane, which indicates the uppermost point of the instrumentation housing tube. Said membrane disposed between the acid container and glass test tube preferably is a glass membrane, said acid in the acid container is concentrated hydrofluoric acid, and said glass test tube contains water adapted to receive the concentrated hydrofluoric acid and dilute said concentrated hydrofluoric acid for etching a horizontal line in the side wall of said glass test tube.

In another embodiment of my invention, said timing means may comprise a normally closed valve disposed between the acid container and the test tube and electrically-powered clock timing means for opening said valve as a predetermined time, whereby said acid will drain by gravity from said acid container into said glass test tube to etch a horizontal line in the wall of the glass test tube to indicate the uppermost point of the instrumentation housing tube.

The means for angularly aligning the acid container and glass test tube with the orientation housing tube comprises a slot formed in the exterior of the wall of the acid container adapted to receive a pin welded into the wall of the instrumentation housing tube, said pin being angularly aligned with the orientation means on the instrumentation housing tube.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DESCRIPTION OF THE PREFERRED EMBODIMENT

Figure 1:
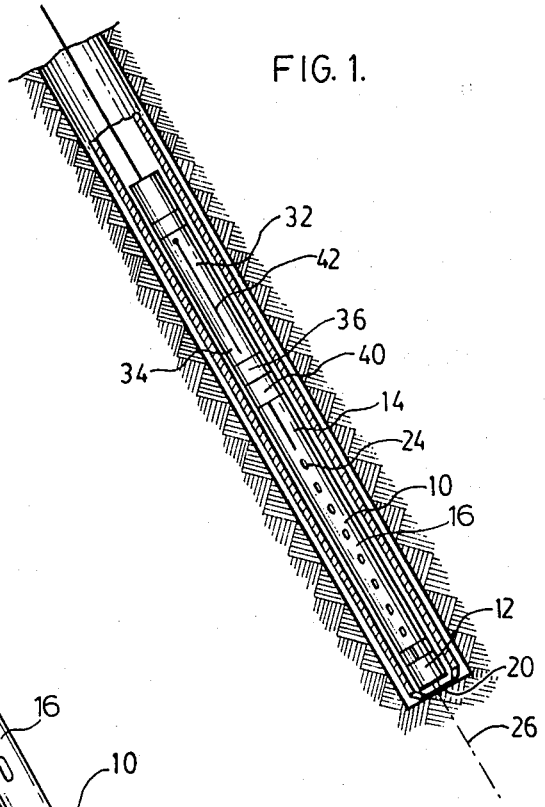
FIG. 1 is a side elevation of the components of the present invention coupled together in a drill hole.
Figure 2:
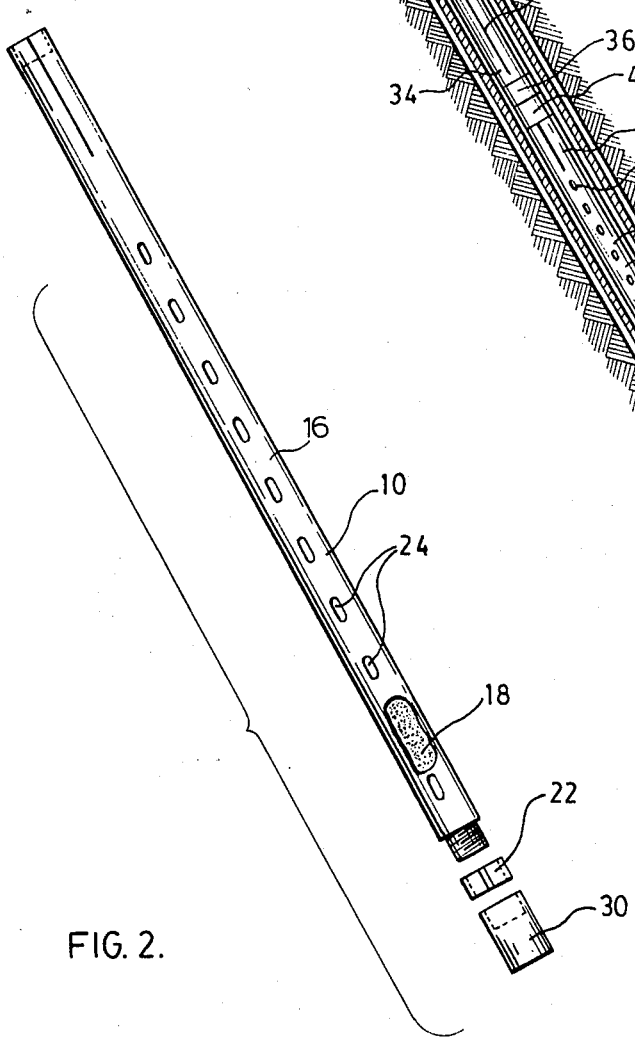
FIG. 2 is a side elevation in more detail of the core sampler shown in FIG. 1.

With reference now to FIG. 1, the core orientation device of the present invention comprises a sampling tube 10 having a front end 12 and rear end 14, said sampling tube being elongated with a cylindrical wall 16 defining cylindrical inner cavity 18, shown more clearly in FIG. 2, adapted to receive a rock core through front end opening 20. Retention means 22 positioned at front end opening 20 are adapted to grasp a core sample for retention within chamber 18.

Sampling tube 10 has a plurality of equispaced slots 24 formed longitudinally along cylindrical wall 16 parallel to the longitudinal axis depicted by numeral 26. FIG. 2 more clearly shows the structure of sampling tube 10 with diamond bit 30 shown axially separated from sampling tube 10 and retention means 22.

Figures 3, 4, 4A:
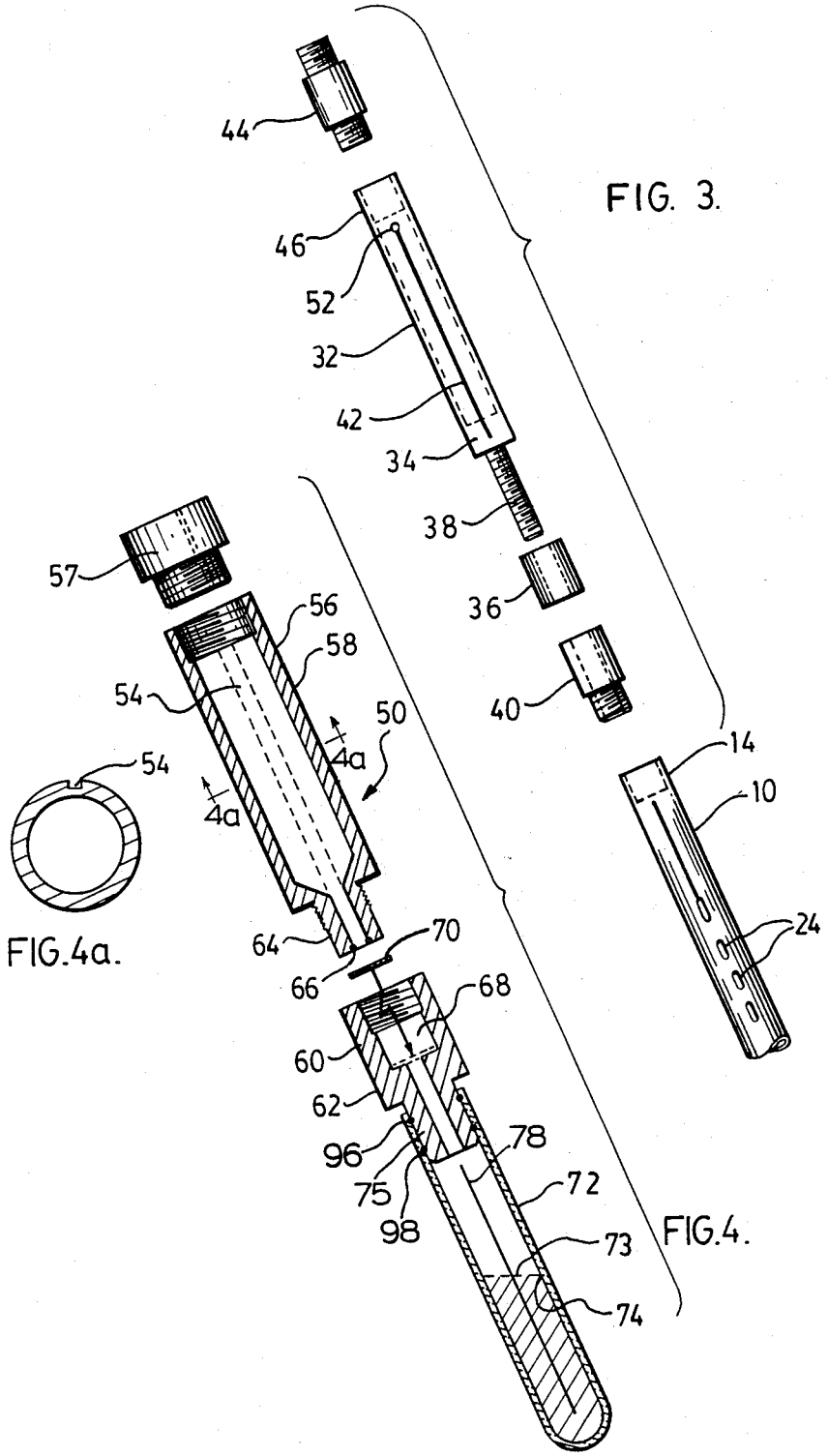
FIG. 3 is a side elevation, partly cut away, of the instrument housing shown in FIG. 1.
FIG. 4 is a longitudinal section of an embodiment of orientation instrument and timing means of the present invention, axially separated, to be contained in the instrument housing shown in FIG. 3.
FIG. 4*a* section through line 4*a*—4*a* in FIG. 4.
Figure 5:
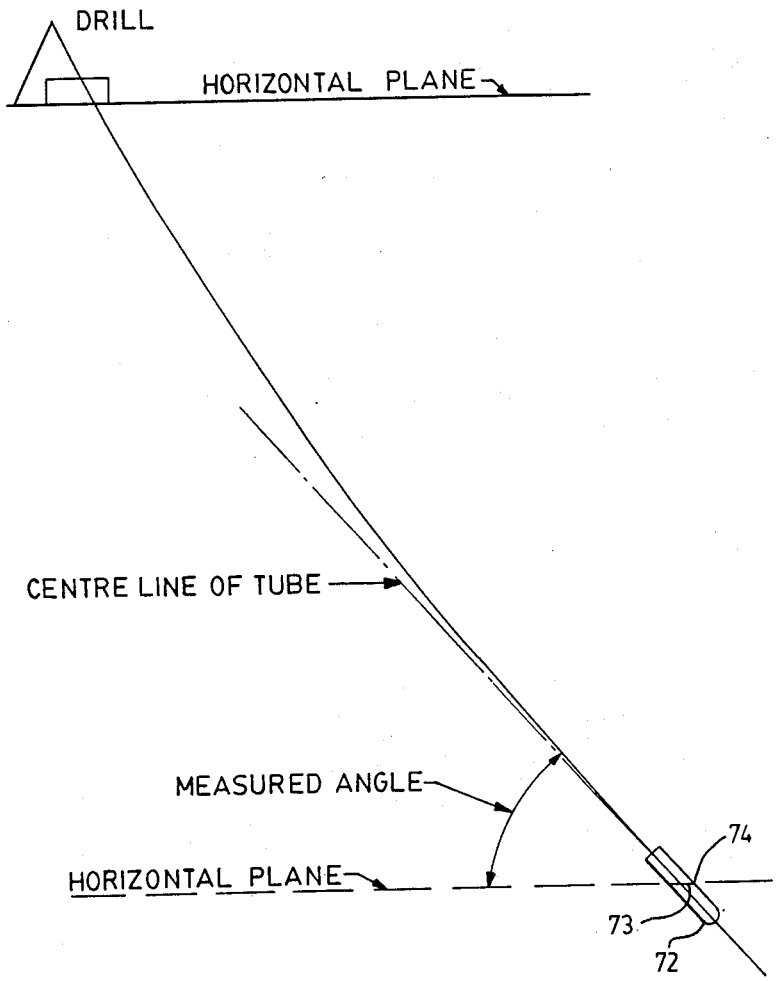
FIG. 5 is a schematic view of the measurement of the dip angle measured by the instrument shown in FIG. 4.
Figure 6:
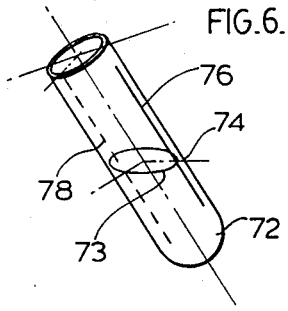
FIG. 6 is a perspective view of a tube having an etched line thereon indicating the top of the hole.

Reverting to FIGS. 1 and 3, instrumentation housing tube 32 is secured at its front end 34 to the rear end 14 of sampling tube 10 by means of threaded shank 38 projecting forwardly from the front end 34 thereof extending into top plug 40 which is adapted to be threaded into the rear end 14 of sampling tube 10. Adjustable locking collar 36 is threaded onto shank 38 to effectively lock the sampling tube to the instrumentation housing tube while permitting angular alignment of longitudinal slots 24 in tube 10 with reference alignment mark 42 formed longitudinally on the exterior of instrumentation housing tube 32.

It will be noted that instrument housing cap 44 is adapted to close the rear end 46 of instrument housing tube 32 and to permit connection to a retrieval mechanism for withdrawal of the sampling tube - instrumentation housing combination from within the drill string by a means of a wire line system, well known in the art.

With reference now to FIGS. 1, 4 and 4*a*, an embodiment of orientation instrument 50 is illustrated. Instrument 50 is inserted into instrumentation housing tube 32 and angularly aligned within housing tube 32 by means of a pin 52 located on reference line 42 and adapted to be inserted into a slot 54 formed in the exterior cylindrical wall 56 of acid container 58.

Acid container 58 is adapted to be threaded into the rear end 60 of housing 62 by means of threaded shank 64 having an O-ring 66 seated in annular recess formed on the inner diameter of the front end of shank 64, as illustrated. A glass membrane 70 of predetermined thickness is adapted to be seated in the base of cylindrical cavity 68, as indicated by broken lines, and a liquid-tight connection made therewith by the abutment of O-ring 66 on membrane 70.

A glass test tube 72 is slidably mounted on forwardly extending shank 75 of housing 62 and a liquid-tight seal provided therewith by means of a pair of spaced apart O-rings 96, 98. Glass test tube 72 has a reference line 78 or like indicia thereon to be maintained in alignment with reference line 42 on housing tube 32 by means of pin 52.

In operation, concentrated hydrofluoric acid of commercial grade (48.8% by weight) is poured into acid container 56 and sealed therein by means of closure cap 57. A quantity of distilled water is placed in test tube 72, the ratio of concentrated hydrofluoric acid to distilled water being sufficient to provide a final acid strength of 2–4% by weight, which is adequate to etch a line in the inner wall of test tube 72 in about 25 minutes, for reasons which will become apparent as the description proceeds.

Glass membrane 70 has a glass thickness relative to the solution strength of the concentrated hydrofluoric acid to permit penetration of the membrane in a predetermined time period of, for example, one-half, one or one and one-half hours. A glass thickness of 0.008 inches (#2 slidecover) relative to the aforementioned commercial grade hydrofluoric acid will permit penetration of the glass membrane in about one-half hour.

Figure 7:
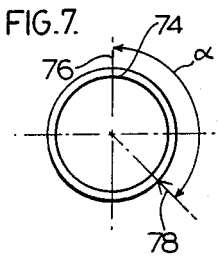
FIG. 7 is a section through a tube shown in FIG. 6 indicating the relationship between top of hole and scribe mark on core.
Figure 8:
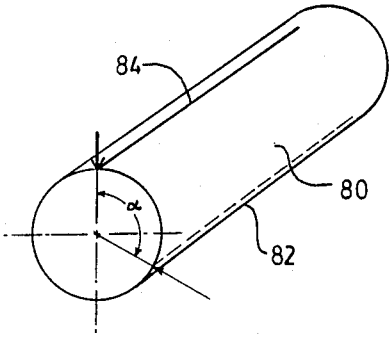
FIG. 8 is a perspective view of core sample with indicia thereon.

Turning now to FIGS. 5–8, FIGS. 5 and 6 illustrate test tube 72 having an etch line 73 formed on the inside of test tube 72, etch line 73 representing the horizontal plane in which the tube was sitting at the time of measurement. Point 74, which is the low point in the wall of the test tube when the test tube is vertically aligned, is used to scribe or draw longitudinal line 76 (FIG. 6) which represents the uppermost side and point of the test tube at the time of measurement. Turning now to FIG. 7, it will be seen that line 76 with low point 74 can be measured angularly from reference line 78 on test tube 72 to determine angle $\alpha$ between their respective radii. In the illustration given in FIG. 7, angle $\alpha$ is shown to be about 135° and, with reference now to the core sample shown in FIG. 8, angle $\alpha$ of 135° can be measured off on the drill core sample 80 relative to scribe marks 82 applied through slots 24 of sampling tube 10. A line 84 thus can be drawn in the uppermost side of each core sample 80 when the core samples are laid horizontally in a core tray, thereby orienting the core samples to their original in situ position prior to being broken from the rock formation and withdrawn from the core hole.

Figure 9:
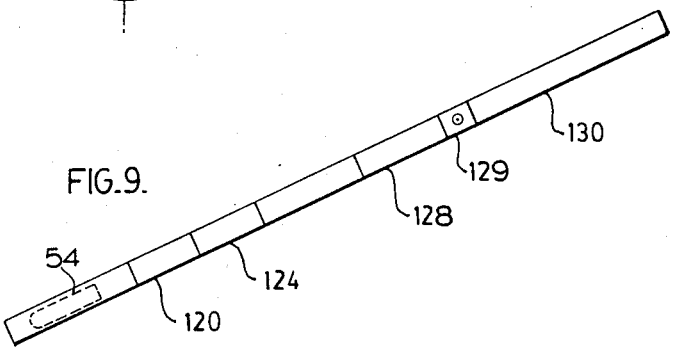
FIG. 9 is a schematic illustration of another embodiment of orientation instrument and timing means of the present invention embodying electrically powered clock timing means.
Figure 10:
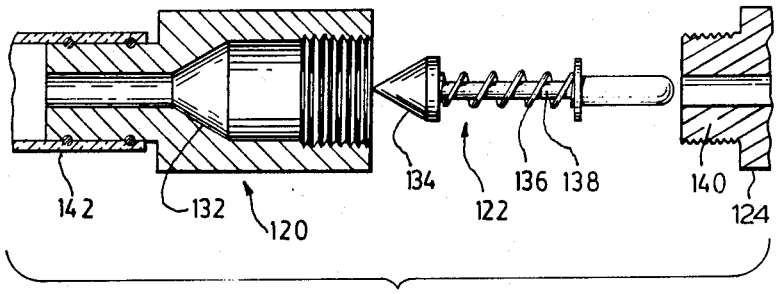
FIG. 10 is a longitudinal section, partly in elevation, of the valve means depicted in FIG. 9.
Figure 11:
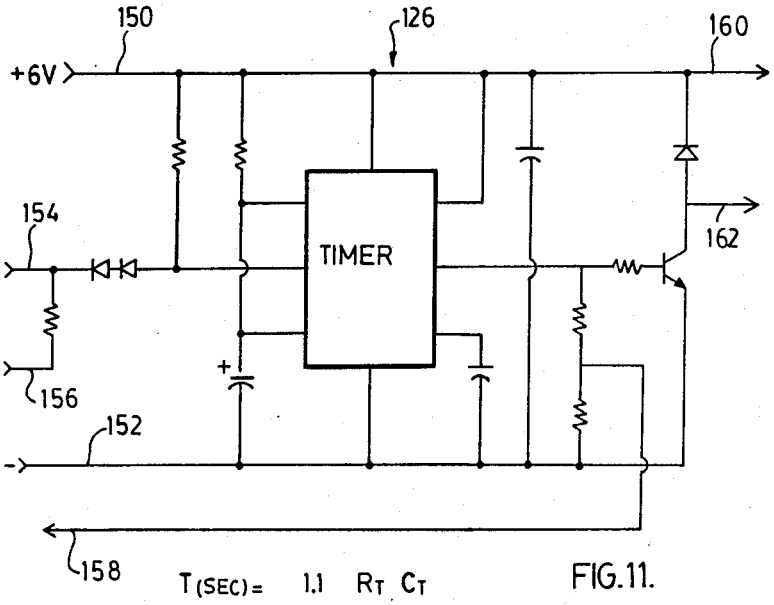
FIG. 11 is a schematice circuit for controlling the valve system shown in FIGS. 9 and 10.

In the embodiment of orientation instrument and timing means shown in FIGS. 9 and 10, acid container 120 has a normally-closed solenoid-actuated valve 122 which is opened at a predetermined time by solenoid 124 such as a Potter and Brunfield S28 series solenoid controlled by timing circuit 126 shown in FIG. 11. The timing circuit comprises power supply leads 150, 152 to 6-volt battery pack 130, control leads 154, 156 from electric alarm clock 128, reset line 158, and power leads 160, 162 to solenoid 124 of valve 120. Valve 120 comprises a valve seat 132 adapted to be normally engaged for closure by plunger 134 having a compression spring 136 concentric with valve stem 138 when threaded shank 140 is screwed into acid container 120. Solenoid 124 is energized by battery pack 130 upon receiving a signal from clock 126 which is amplified by circuit 126.

In operation, the user sets clock 128 to be actuated and actuates power switch 129 at a predetermined time, at which time solenoid 140 is energized to retract valve 122 and to open valve seat 132 to permit concentrated acid or diluted acid having an acid strength of 2–4% by weight as described above to drain from acid container 122 into test tube 142 upon opening of valve 120 for etching of a horizontal line, as has been described above.

I have found that a suitable horizontal line can be etched in a test tube by directly charging the test tube'at the surface with a 4% by weight acid, running the sampling and orientation apparatus down the drill hole, coring the desired length of core sample, and allowing the orientation apparatus to remain stationary for about 30 minutes. A separate acid receptacle and time-delay device is not required in this embodiment of my invention.

It will be understood, of course, that modifications can be made in the embodiments of the invention illustrated and described herein without departing from the scope and purview of the invention as defined by the appended claims.

I claim:

1. A core sampling and orientation apparatus comprising, in combination, a sampling tube having a front end and a rear end, said sampling tube having a cylindrical wall and a front end opening for receiving a core sample from a rock formation, said sampling tube including retention means for grasping said core sample, and said sampling tube having a plurality of aligned slots formed longitudinally along the cylindrical wall parallel to the tube longitudinal axis, said slots having a width sufficient to permit the scribing of a line along a core contained within the sampling tube, an instrumentation housing tube having a front end and a rear end, means for securing the rear end of the sampling tube to the front end of the instrumentation tube, angular orientation means formed on the instrumentation housing tube to permit angular alignment of the sampling tube and said plurality of slots with the instrumentation housing tube, and means contained within said instrumentation housing tube for indicating the uppermost position of the instrumentation housing tube at a predetermined time during sampling, relative to the angular orientation means, whereby the core sample can be subsequently orientated to its original formation position and a line scribed along the core sample through the plurality of aligned slots.

2. A core sampling and orientation apparatus as claimed in claim 1, wherein said sampling tube has the plurality of slots formed equidistant along the cylindrical wall.

3. A core sampling and orientation apparatus as claimed in claim 2 wherein said angular orientation means for angular alignment of the sampling tube with the instrumentation housing tube comprises longitudinal lines formed on the sampling tube and instrumentation housing tube parallel to the respective axis thereof.

4. A core sampling and orientation apparatus as claimed in claim 3 wherein said means contained within the instrumentation housing tube for indicating the uppermost position of the instrumentation housing tube at a pre-determined time during sampling comprises a glass test tube adapted for angular alignment within the instrumentation housing tube, said test tube having a mark indicating alignment with the slots of the sampling tube, and a glass-reactive acid for etching a horizontal line in said glass test tube to indicate the uppermost position thereof.

5. A core sampling and orientation apparatus as claimed in claim 4 additionally comprising an acid container for the glass-reactive acid and timing means for feeding the said acid into the glass test tube at a predetermined time, wherein said timing means comprise a membrane disposed between said acid container and the glass test tube, said membrane being reactive to the acid in the acid container whereby said acid will perforate said membrane in a predetermined period of time to permit acid to drain by gravity from said acid container into said glass test tube to mark a horizontal line in the wall of the glass test tube to indicate the uppermost position of the instrumentation housing tube.

6. A core sampling and orientation apparatus as claimed in claim 5 wherein said membrane disposed between the acid container and glass test tube is a glass membrane, said acid in the acid container is concentrated hydrofluoric acid, and said glass test tube contains water adapted to receive the concentrated hydrofluoric acid and dilute said concentrated hydrofluoric acid for etching a horizontal line in the wall of said glass test tube.

7. A core sampling and orientation device as claimed in claim 3, additionally comprising an acid container for the glass reactive acid and timing means for feeding the said acid into the glass test tube at a predetermined time, said timing means comprising a normally-closed valve disposed between the acid container and the glass test tube and electrically powered clock control means for opening said valve at a predetermined time, whereby said acid will drain by gravity from said acid container into said glass test tube for etching a horizontal line in the wall of the glass test tube.

8. A core sampling apparatus as claimed in claim 6 wherein said means for angularly orientation of the acid container and glass test tube with the instrumentation housing tube comprises a slot formed in the exterior of the wall of the acid container adapted to receive a pin projecting from the wall of the instrumentation housing tube, said pin being angularly aligned with the angular orientation means in the instrumentation housing tube.

9. A core sampling apparatus as claimed in claim 7 wherein said means for angularly orientation the acid container and glass test tube with the instrumentation housing tube comprises a slot formed in the exterior of the wall of the acid container adapted to receive a pin projecting from the wall of the instrumentation housing tube, said pin being angularly aligned with the angular orientation means in the instrumentation housing tube.

* * * * *